United States Patent [19]

Söderlund et al.

[11] Patent Number: 4,597,726

[45] Date of Patent: Jul. 1, 1986

[54] SCREW COMPRESSOR HAVING TWO INDIVIDUALLY DISPLACEABLE REGULATING SLIDES

[75] Inventors: Frits Söderlund, Saltsjöbaden; Kurt Karlsson, Tyresö, both of Sweden

[73] Assignee: Svenska Rotor Maskiner Aktiebolag, Stockholm, Sweden

[21] Appl. No.: 731,886

[22] Filed: May 8, 1985

[30] Foreign Application Priority Data

May 11, 1984 [SE] Sweden ..... 8402563

[51] Int. Cl.[4] ..... F01C 1/18

[52] U.S. Cl. ..... 418/201; 417/310

[58] Field of Search ..... 418/152, 153, 201; 417/310, 440

[56] References Cited

U.S. PATENT DOCUMENTS

| | | | |
|---|---|---|---|
| 3,088,659 | 5/1963 | Nilsson | 418/201 |
| 3,977,818 | 8/1976 | Sprankle | 418/201 |
| 3,989,413 | 11/1976 | McGahan | 417/310 |

FOREIGN PATENT DOCUMENTS

| | | | |
|---|---|---|---|
| 134806 | 10/1979 | Japan | 418/201 |
| 2076896 | 12/1981 | United Kingdom | 418/201 |
| 2119446 | 4/1983 | United Kingdom . | |
| 2122687 | 6/1983 | United Kingdom . | |
| 1092300 | 11/1982 | U.S.S.R. . | |

OTHER PUBLICATIONS

Shaw, David N., "*Proceedings of the DOE Heat Pump Contractors' Program Integration Meeting*", published Mar. 1982.

*Primary Examiner*—Leonard E. Smith
*Assistant Examiner*—Jane E. Obee
*Attorney, Agent, or Firm*—Frishauf, Holtz, Goodman & Woodward

[57] ABSTRACT

A screw compressor having two rotors (2,3) rotatably journalled for mutual meshing engagement in a respective working chamber (4,5) of a compressor housing (1). For the purpose of regulating the pressure ratio and the capacity of the compressor, a composite slide assembly comprising two slides (17,18) is mounted for axial movement in a recess (6) in the housing (1), the composite slide having two flanks which form a continuous wall in the two working chambers (4,5). The two slides are individually movable and, for the purpose of improving the regulating function one of the slides (18) is provided with a flank which forms a wall of the working chamber (4) of solely one rotor, preferably the male rotor (2).

8 Claims, 4 Drawing Figures

SCREW COMPRESSOR HAVING TWO INDIVIDUALLY DISPLACEABLE REGULATING SLIDES

BACKGROUND OF THE INVENTION

The present invention relates to a screw compressor of the kind having two screw rotors journalled in meshing engagement in a housing which encloses a working chamber for each rotor and which incorporates a low pressure side-wall, a high pressure wall, an inlet port and an outlet port, and also an axial recess which includes a continuous part of the wall of both the rotor working chambers and extends out through at least the high pressure wall, there being mounted in said recess two slides which are arranged for mutually independent axial movement for controlling the built-in volume ratio and the capacity of the compressor.

Regulating slides of this and similar kinds play an essential part in effecting the changes in the volume ratio and the capacity of screw compressors which become necessary as a result of varying operating conditions. At the same time the regulating slides create a complication in an otherwise uncomplicated screw compressor.

Initially the two individual regulating slides were mounted in separate recesses in the rotor housing, as evidenced in Swedish Patent Specification No. 218 783 for example, particularly FIGS. 1 and 2 (corresponding to U.S. Pat. No. 3,088,659; FIGS. 5 and 6). Although this slide arrangement allows the slides to move axially individually of one another, without mutual interference in the event of slide-seizure due to thermal expansion, the provision of separately arranged slides creates difficulties and problems in manufacture and results in unavoidable throttling of the outlet port.

Consequently, attempts have been made to combine the two slides into a composite slide assembly similar to the conventional slide intended for regulating the built-in volume ratio, but with the one slide mounted for axial movement in the other slide, as disclosed in the publication "Annual DOE active solar heating and cooling contractors review meeting", September 81, U.S. Department of Energy. Although this slide design is constructionally more simple, it still throttles the outlet port to some extent. An additional drawback is that the bearing play in the outer slide is added to the bearing play in the inner slide. This additional play presents a serious disadvantage, since the inner slide carries the pointed spine part which projects inwardly to a location extremely close to the mesh point of the rotors and where contact therewith could have serious consequences. The risk of this happening is quite strong in view of the aforesaid combined play, and an object of the present invention is accordingly to provide a safer and improved design without incorporating further complications.

SUMMARY OF THE INVENTION

The above has been achieved in accordance with the present invention by providing one slide with a flank which forms a wall for the working chamber of solely the one rotor. The other slide can therewith include the pointed spine part and since this slide is journalled directly in the stationary compressor housing the spine part is afforded no additional movement as a result of combined play.

According to one preferred embodiment of the invention, the aforesaid one slide is arranged to adjoin solely the working chamber of the male rotor, there being obtained in this way a capacity control slide which results in the least possible disturbance of a radial outlet port without decreasing the capacity of the compressor, thus affording an improved function.

The recess or slot provided for the arrangement of one slide within the other suitably has the form of an asymmetrical axial bore formed in said other slide, which is a relatively simple manufacturing operation.

Since the flank of the aforesaid one slide shall form the wall of solely the working chamber of the one rotor, the flank can be extended right to the pointed spine part of the composite slide assembly, through which spine part there can be placed a dividing plane which divides the slide assembly into two substantially equal parts, i.e. the two slides are arranged on an axial centre plane.

DETAILED DESCRIPTION

Figure 1:
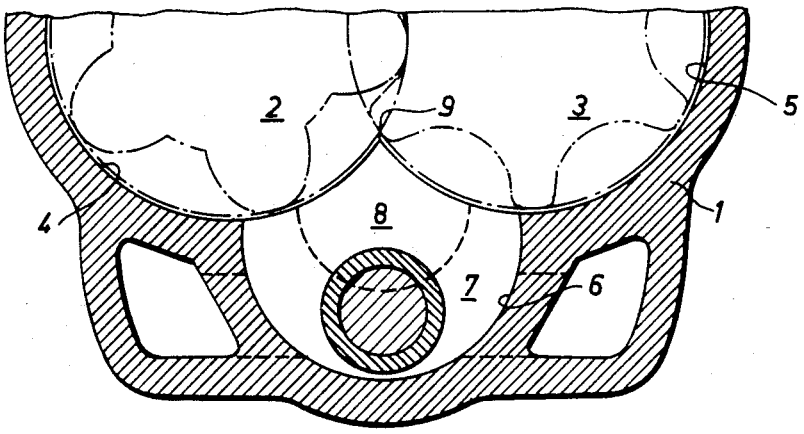
Fig.1 Prior Art
FIG. 1 is a cross-sectional view of part of a compressor housing illustrating the positioning of the conventional slides.

FIG. 1 illustrates a conventional screw-compressor housing 1 in which a male rotor 2 and a female rotor 3 are journalled for rotation in a respective working chamber 4 and 5, in mesh with one another. Arranged for axial movement in an axial bore 6 is a composite slide assembly which comprises two slides 7,8. The composite slide assembly is symmetrical with respect to an axial vertical plane between the centre lines of the rotors, and the slide 8 is axially displaceable in relation to the slide 7. The two slides 7,8 have flanks which form a part of the walls of the working chambers 4,5, and the inner slide 8 includes a pointed spine part 9 at which the walls of the two working chambers meet.

As is known, there is very little clearance between the rotors 2,3 and the flanks of the slides 7,8, which places high demands on the slide bearings and on guides intended to prevent rotational movement or twisting of the slides. The pointed spine part 9 is particularly subjected to unintentional contact, due to the fact that it is located on the inner slide 8, which is journalled in the movably mounted slide 7. The slide utilized in this embodiment as a capacity control slide will also be located in a manner which causes it to close part of the radial outlet-port in an undesirable manner, as explained in more detail hereinafter with reference to FIG. 2.

Figure 2:
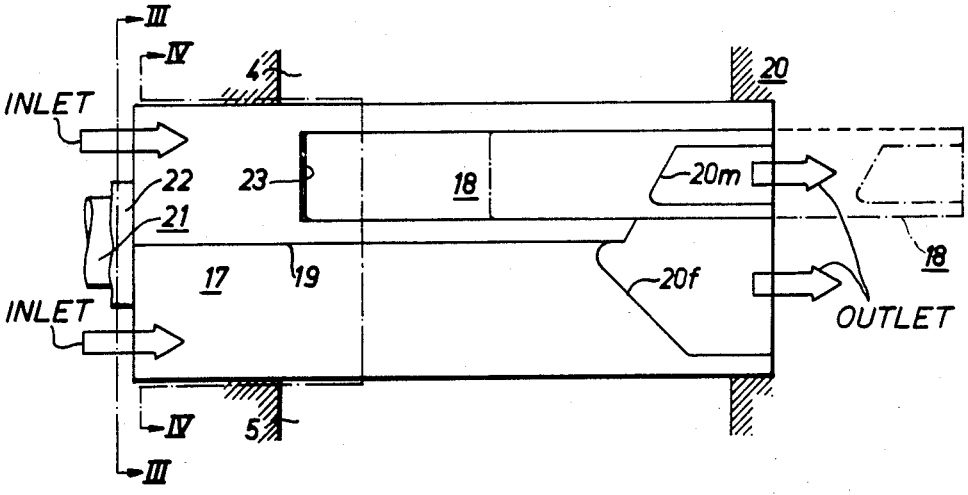
FIG. 2 is a plan view which illustrates the positioning of the two slides according to the invention relative to the working chambers accommodating the rotors, in which view obstructing structural parts of the compressor housing have been omitted for the sake of illustration.
Figure 3:
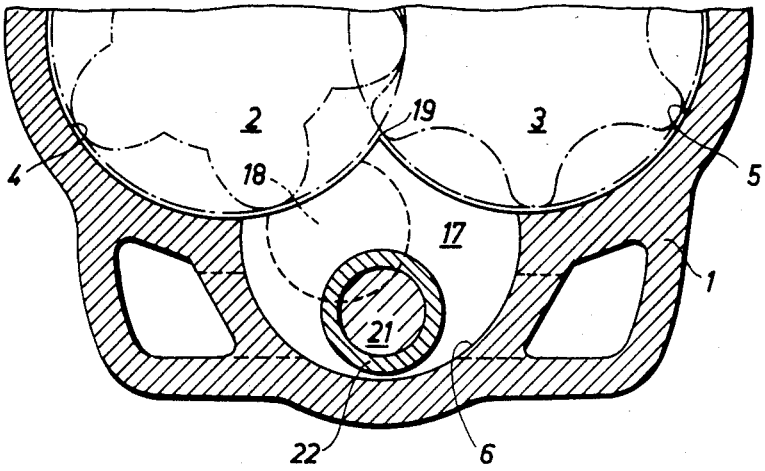
FIG. 3 is a cross-section view of part of the rotor housing, taken on the line III—III in FIG. 1.

Both of these disadvantages are eliminated totally or partially by the invention, according to which the conventional composite slide is modified so that the one slide is provided with a flank which forms a wall of solely the working chamber of one rotor, as shown in FIGS. 2 and 3. The outer slide 17 is intended for regulating the pressure ratio or the built-in volume ratio, while the inner slide 18 is intended for regulating capacity, and is offset laterally in comparison with the earlier illustrated known design (FIG. 1), so that its flank becomes part of the wall 4 of the working chamber of solely the male rotor 2. In the FIG. 2 embodiment the pointed spine part 19 (corresponding to the pointed spline part) 9 of FIG. 1 is referenced 19 and is located on the outer slide 17.

As seen in FIG. 2, the high-pressure side-wall of the compressor housing 1 is located at 20, and one end of the composite slide 17,18 is able to protrude through an opening located in the high-pressure side-wall 20, said opening also being effective to prevent rotation of the slide assembly by engagement with the flanks of the slides 17,18. The slides are maneuvered with the aid of a conventional pull-rod 21 connected to the slide 18, and a hollow shaft 22 connected to the slide 17 through connecting means not shown.

As will be seen from FIG. 2, the slide 18 can be displaced from the slide 17 to some considerable extent, wherewith there is formed an aperture on the low pressure side, between a surface 23 on the slide 17 and the inner end of the slide 18, this aperture communicating in a conventional manner with the compressor inlet, to reduce the capacity of the compressor. Parts 20*m* and 20*f* define outlets of the compressor at the high pressure side thereof. It will be observed that the slide 18 will always move on the male-rotor side of the radial part of the outlet port, where it is least impeded, in distinction to the known capacity control slide shown in FIG. 1, this known slide being located on the female-rotor slide, where it impedes the most.

Figure 4:
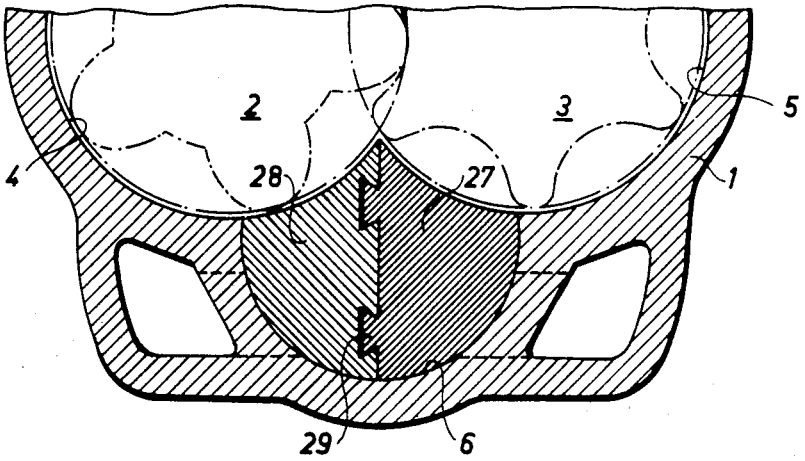
FIG. 4 is a cross-sectional view taken on the line IV—IV in FIG. 1, there being used in this embodiment a modified version of the slides illustrated in FIGS. 2 and 3.

The composite slide assembly may also have the form illustrated in FIG. 4, incorporating a capacity control slide 28 which comprises substantially one half of the composite slide assembly and is mounted for axial movement on the other half 27 of the assembly through the agency of linear guides 29.

We claim:

1. A screw compressor compsriing:

male and female screw rotors (2,3) which are journalled for mutual meshing engagement in a housing (1) which encloses a respective working chamber (4,5) for each of the rotors, the housing (1) being provided with a low-pressure side wall, a high-pressure side-wall (20), an inlet port and an outler port;

a single axial recess (6) in said housing (1) which includes a continuous part of walls of the working chambers (4,5) of the two rotors, said single axial recess extending out through at least said high-pressure side-wall (20); and two slides (17,18; 27,28) arranged for mutually independent axial movement in said single axial recess (6) for respectively regulating the built-in volume ratio and the capacity of the compressor;

one of said slides (18;28), which regulates the capacity of the compressor, having a flank which forms a wall of the working chamber (4) of solely one of said rotors, said one of said slides (18;28) not directly communicating with the working chamber of the other of said rotors.

2. The screw compressor of claim 1, wherein the other of said slides (17), which regulates the built-in volume ratio of the compressor, has an asymmetric axial bore therein, said one slide (18) being axially slideably arranged in said asymmetric, axial bore of said other slide (17).

3. The screw compressor claim 1, wherein said two slides (27,28) are substantially symmetrical with respect to an axial centre plane thereof.

4. The screw compressor of claim 3, wherein said two slides (27,28) comprise interengaging linear guides (29) substantially at said axial centre plane for slidingly guiding said slides for relative movement therebetween.

5. The screw compressor of claim 1, wherein said flank of said one slide (18;28) adjoins solely the working chamber (4) of the male rotor (2).

6. The screw compressor of claim 5, wherein the other of said slides (17), which regulates the built-in volume ratio of the compressor, has an asymmetric axial bore therein, said one slide (18) being axially slideably arranged in said asymmetric, axial bore of said other slide (17).

7. The screw compressor of claim 5, wherein said two slides (27,28) are substantially symmetrical with respect to an axial centre plane thereof.

8. The screw compressor of claim 7, wherein said two slides (27,28) comprise interengaging linear guides (29) substantially at said axial centre plane for slidingly guiding said slides for relative movement therebetween.

* * * * *

UNITED STATES PATENT AND TRADEMARK OFFICE

CERTIFICATE OF CORRECTION

PATENT NO. : 4,597,726

DATED : July 1. 1986

INVENTOR(S) : SODERLUND et al

It is certified that error appears in the above-identified patent and that said Letters Patent is hereby corrected as shown below:

IN THE TITLE: Change the Title to read as follows:

--SCREW COMPRESSOR HAVING CAPACITY REGULATING SLIDE ADJOINING SOLELY THE WORKING CHAMBER OF ONE ROTOR--.

UNITED STATES PATENT AND TRADEMARK OFFICE

CERTIFICATE OF CORRECTION

PATENT NO. : 4,597,726

DATED : July 1, 1986

INVENTOR(S) : SODERLUND et al

It is certified that error appears in the above-identified patent and that said Letters Patent is hereby corrected as shown below:

COLUMN 1, line 47, after "extent", insert --when the slide working as the capacity control slide is moved to extend out through the high pressure wall--;

COLUMN 1, line 66, after "housing", insert -- , --;

COLUMN 3, line 6, change "spline" to --spine--;
after "part", delete ")";
after "FIG. 1", insert --)-- and delete "is referenced 19 and";

COLUMN 3, line 42 (claim 1), change "compsring" to --comprising--;

Signed and Sealed this

Sixteenth Day of December, 1986

*Attest:*

DONALD J. QUIGG

*Attesting Officer* *Commissioner of Patents and Trademarks*